US006317916B1

(12) United States Patent
Smith

(10) Patent No.: US 6,317,916 B1
(45) Date of Patent: Nov. 20, 2001

(54) PORTABLE GOLF CLUB CLEANING DEVICE

(76) Inventor: Jeff Smith, 1875 Hill Chase, Alpharetta, GA (US) 30022

( * ) Notice: Subject to any disclaimer, the term of this patent is extended or adjusted under 35 U.S.C. 154(b) by 0 days.

(21) Appl. No.: 09/535,238

(22) Filed: Mar. 27, 2000

(51) Int. Cl.[7] ..... B08B 3/00

(52) U.S. Cl. ..... 15/104.92; 15/160; 15/210.1

(58) Field of Search ..... 15/21.2, 160, 104.92, 15/210.1; 150/159, 160; 206/315.2, 315.3

(56) References Cited

U.S. PATENT DOCUMENTS

| | | | | |
|---|---|---|---|---|
| 2,530,746 | * | 11/1950 | Wetherby . | |
| 2,968,825 | * | 1/1961 | Wetherby . | |
| 3,748,676 | * | 7/1973 | Warren et al. . | |
| 4,069,536 | | 1/1978 | Hartz et al. | 15/104.92 |
| 4,734,952 | | 4/1988 | Parchment et al. | 15/104.92 |
| 4,944,063 | * | 7/1990 | Jordan . | |
| 4,945,596 | * | 8/1990 | Chang et al. . | |
| 4,965,906 | * | 10/1990 | Mauro . | |
| 5,155,883 | | 10/1992 | Legault | 15/21.2 |
| 5,404,610 | | 4/1995 | Coyer, Sr. et al. | 15/104.92 |
| 5,666,684 | | 9/1997 | Cussen | 15/104.92 |
| 5,732,435 | | 3/1998 | Williams et al. | 15/104.92 |
| 5,770,284 | * | 6/1998 | Logemann . | |

* cited by examiner

*Primary Examiner*—Terrence R. Till
(74) *Attorney, Agent, or Firm*—Troutman Sanders LLP; Wm. Brook Lafferty

(57) ABSTRACT

A portable golf club cleaning device for cleaning the head of a golf club suitable for carrying and storing with a golf bag. The cleaning device includes a collapsible container for holding a cleaning liquid. A plurality of brushes extend from a housing surrounding the opening of the collapsible container. Once the cleaning liquid is removed from the collapsible container, the golf club cleaning device may be stored in a minimum of space.

22 Claims, 2 Drawing Sheets

PORTABLE GOLF CLUB CLEANING DEVICE

TECHNICAL FIELD

The present invention relates to accessories for golf clubs and, more specifically, a portable device for cleaning the head of the golf club.

BACKGROUND OF THE INVENTION

There is a myriad of golfing accessories available to golfers. Some accessories are directed towards maintaining the golfer's equipment. After swinging a club, the head of the club often comes into contact with the ground and creates what is commonly referred to as a divot in the ground. Consequently, grooves in the head of the club become filled with dirt and the toe or heal of the club becomes scuffed. Typically, at a driving range, a container of water is provided so that the golfer is able to brush and clean the head of his club. However, these containers are not suited for transportation between holes during a round of golf.

Most holes of golf require more than one swing of the club to complete the hole. Consequently, once the golfer has left the tee after the first shot on a hole of golf, there is no device for cleaning the club. Therefore, if the golfer is to clean his club while in the middle of completing a hole of golf, he typically has to use a towel, preferably with water, to clean the club head.

Therefore, there is a need for an individually portable cleaning device for golfers. This new cleaning device must provide an ample supply of water during a round of golf while also being capable of being packed away with the golfer's other equipment at the end of the day.

SUMMARY OF THE INVENTION

The present invention solves the above-identified problem by providing a portable golf club cleaning device. This novel golf club cleaning device allows golfers to clean their club heads while on the move. After a game of golf, the cleaning device is collapsed to be stored in a minimum of space.

Generally described, the portable golf club cleaning device of the present invention includes a collapsible chamber having an opening at an upper end to receive and contain cleaning liquid. A housing having a plurality of brushes is coupled to the upper end of the collapsible chamber. The brushes engage the club head when the club head is received through the housing and into the collapsible chamber.

In one aspect of the present invention, the collapsible container is a flexible bladder which may be collapsed when emptied of the cleaning liquid. Preferably, the housing is removable from the flexible bladder to clean the bladder or the bladder may be replaced with another bladder.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
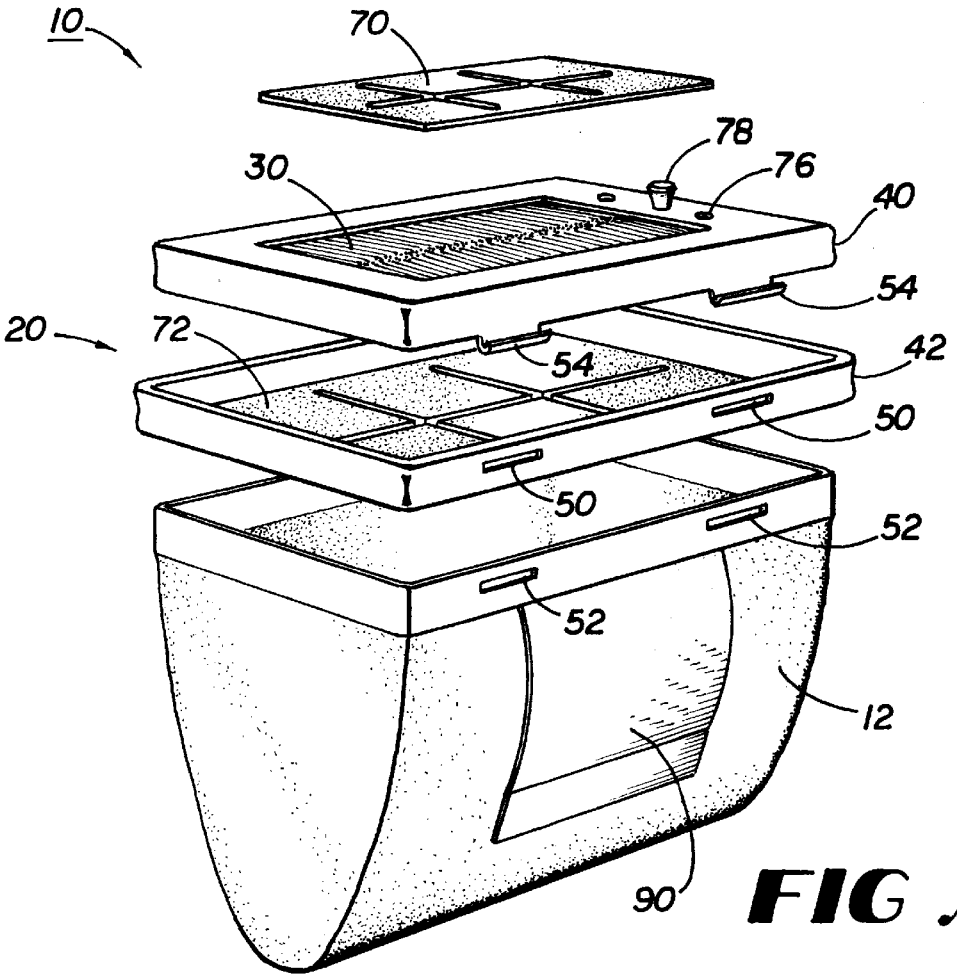
FIG. 1 illustrates a perspective, exploded, back view of one embodiment of the portable golf club cleaning device of the present invention.

Referring now to the drawings in which like numerals indicate like elements throughout the several views, FIG. 1 depicts one embodiment of a portable golf club cleaning device 10 of the present invention. The cleaning device 10 includes a collapsible chamber having an opening at an upper end to receive and contain the cleaning liquid. The collapsible chamber may take a variety of forms suitable for permitting the cleaning device to be stored in a minimum of space, and those skilled in the art will appreciate that the present invention is not limited to a particular material, but may be enhanced based on the type of material and the particular application of the invention.

Figure 2:
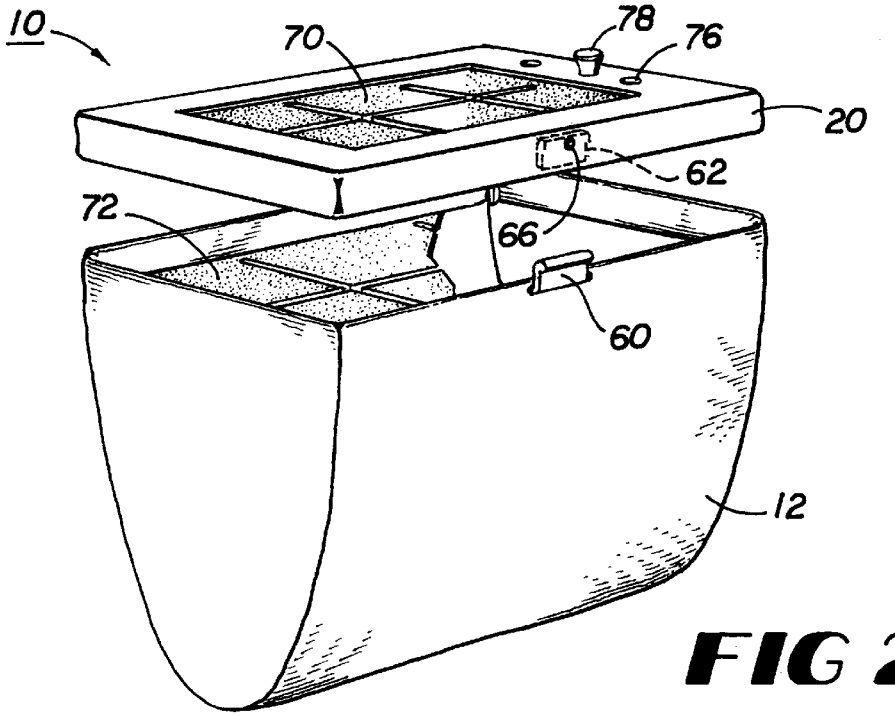
FIG. 2 is a perspective, front view of the portable golf club cleaning device of FIG. 1.

In one embodiment, shown in FIGS. 1 and 2, the collapsible container is a flexible bladder 12 made of a water-impermeable material such as rubber or vinyl-coated cloth, or the like. A housing 20 is coupled to the upper end of the bladder 12. The housing 20 itself defines an opening which communicates with the opening in the bladder 12. Preferably, the housing 20 is rigid and is releasably attached to the bladder 12 so that the bladder 12 may be removed from the housing 20 for disposal of cleaning liquid. The bladder 12 may be removed from the housing 20 for disposal and be replaced with another bladder 12. The housing 20 is made of any suitable material, such as a high-impact polymer, for biasing the upper end of the bladder 12 to remain open. In alternative embodiments, the housing 20 is only semi-rigid or only slightly more rigid than the flexible bladder 12 and may be deformed somewhat in order to collapse the cleaning device 10 and store it in a minimum of space. In such case, the housing may be made of plastic, rubber, or other suitable material that will bend, but will also bias the bladder 12 to remain open during use.

To remove the bladder 12 from the housing 20, the housing preferably includes interlocking inner and outer frames 40 and 42, respectively. As best shown in FIGS. 1 and 2, the inner and outer frames 40, 42 are configured to receive the flexible bladder 12 therebetween when the frames 40, 42 are interlocked together. The upper edge of the bladder is placed around the exterior periphery of the outer frame 42, up over the outer frame 42, and folded down into the inside of the outer frame 42. The outer frame 42 includes a pair of laterally displaced openings 50 that correspond with a pair of laterally displaced openings 52 in the flexible bladder 12. Preferably, the openings 52 are adjacent the edge of the bladder's upper end opening.

The openings 50 in the inner frame 40 should be aligned with the openings 52 in the bladder 12. A pair of laterally displaced, outwardly extending hooks 54 on the inner frame 40 are configured to receive and concurrently retain both pairs of openings 50, 52. Because the hooks 54 extend outward, the hooks 54 are first placed through the openings 52 in the bladder 12 then through the openings 50 in the outer frame 42 from the inside of the outer frame 42.

In an alternative embodiment, the bladder 12 may be secured to the housing by a method known in the art as sonic welding which is commonly used to combine plastic and other materials together.

The cleaning device 10 further includes a plurality of brushes 30 for engaging the club head (not shown) when the club head is received in the cleaning device 10. In one embodiment, the brushes 30 are mounted to the housing 20 and extend inward from the housing 30 over the opening in the collapsible container.

In one embodiment of the present invention, the inside of the outer frame 42 includes a resilient retaining tab 60 and the inner frame 40 includes a corresponding tab receiving chamber 62. The retaining tab 60 is detachably receivable in the tab receiving chamber 62 with a snap-fit.

The inner frame 40 further includes a horizontally oriented hole 66 communicating with the tab receiving chamber 62. The retaining tab 60 may be detached from the tab receiving chamber 62, to permit the flexible bladder 12 to be removed from the housing 20, when an elongated object, such as a golf tee, or other suitable device, is received through the horizontally oriented hole 66 and is urged against the retaining tab 60. By pressing against the retaining tab 60, the tab's contact with the inside of the tab receiving chamber 62 is broken and the retaining tab 60 may then be removed from the tab receiving chamber 62. Consequently, the inner and outer frames 40, 42 are permitted to separate and the flexible bladder 12 may be removed from the frame 20.

The cleaning device 10 of the present invention may further include a plurality of flexible flap members. The flap members collectively close the opening in the housing when the flap members are in repose. The flap members are displaceable to permit insertion of the golf club head into the collapsible container.

Preferably, a first set of flap members 70 is affixed to the housing 20 above the plurality of brushes 30 and a second set of flap members 72 is affixed to the housing 20 beneath the plurality of brushes 30. As shown in the embodiment in FIG. 1, the first set of flap members 70 is affixed to the inside of the inner frame 40 and the second set of flap members 72 are affixed to the inside of the outer frame 42. The flap members 70 prevent the brushes 30 from spraying liquid out of the cleaning device 10 and the flap members 72 prevent the liquid from spilling out of the flexible bladder 12. Moreover, because the flap members 70 and 72 are aligned with one another, the flap members 70 and 72 cooperate together for insertion of the golf club head into the collapsible container.

Figure 4:
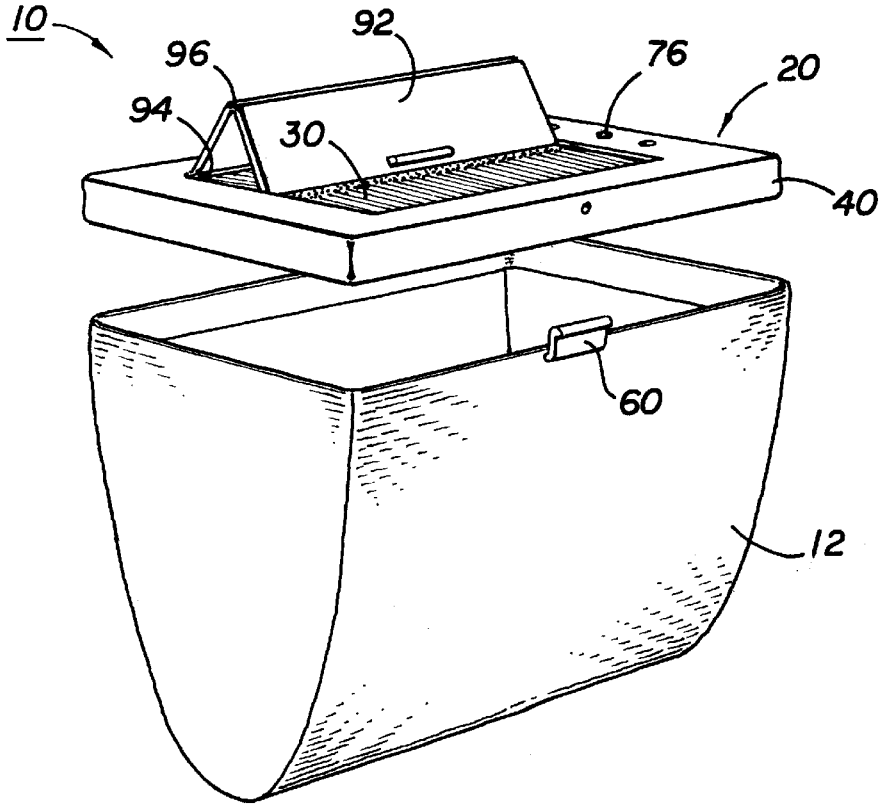
FIG. 4 is a perspective view of one embodiment of the portable golf club cleaning device of the present invention modified with a door mounted to the housing.

Alternatively, a door may be mounted to the housing 20 for preventing the spilling of the cleaning liquid. The door can be slidably mounted to the housing to cover the opening in the housing in the collapsible container. However, the door is preferably attached to the housing with a hinge or the like to enable the door to pivot between open and closed positions. In either case, the door is opened to permit insertion of the club head for cleaning. In FIG. 4, a door 92 includes a pair of hinges 94 and 96. Hinge 94 attaches the door 92 to the inner frame 40 of the housing 20 and hinge 96 bisects the door 92 so that the door 92 will fold up onto itself. The hinges 94 and 96 are preferably made by creating a fold line in the material of the door 92 when manufactured by a method known in the art. Preferably, the door is made of a material similar to the housing 20.

Figure 3:
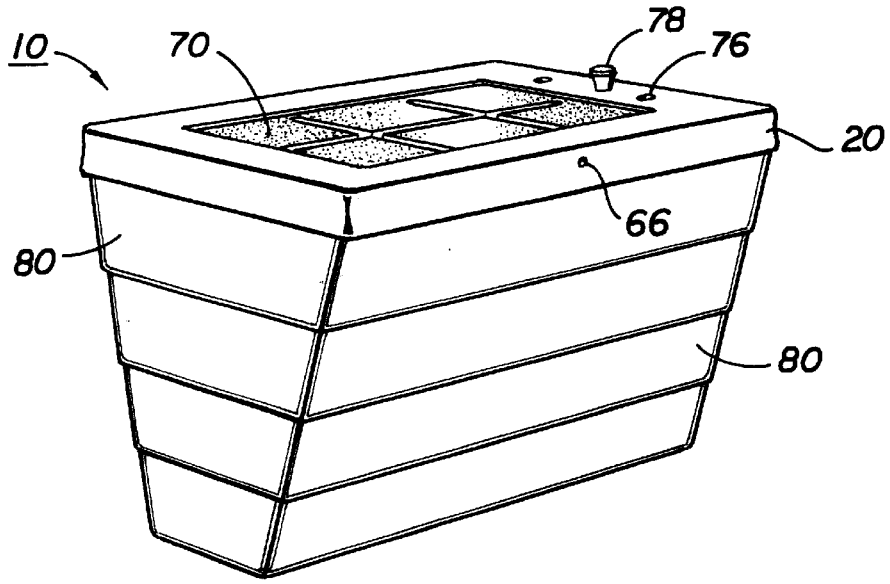
FIG. 3 is a perspective view of an alternative embodiment of the portable golf club cleaning device of the present invention.

In one embodiment, the frame 20 may include at least one vertically oriented hole 76 for receiving and retaining golf tees 78. FIGS. 1–3 each illustrate tees 78 retained in vertically oriented holes 76. One of the tees 78 retained in the holes 76 may be used to detach the retaining tab 60 from the retaining tab chamber 62 as described above.

In an alternative embodiment, shown in FIG. 3, the collapsible container includes a plurality of annular segments 80 of graduated diameters which are extendible. When extended, the annular segments 80 form a water-tight container. Preferably, the segment with the largest diameter is affixed to the housing 20 and the annular segments 80 are collapsible around the segment with the smallest diameter.

The cleaning device 10 of the present invention may also include an exterior strap 90 mounted to the back of the cleaning device 10. The strap 90 may be mounted to the cleaning device 10 in any manner suitable for securing the cleaning device 10 to a golf bag or golf cart. In the embodiment shown in FIG. 1, the strap 90 is mounted in a vertical manner to the exterior of the flexible bladder 12.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A portable golf club cleaning device for cleaning the head of a golf club with a cleaning liquid, said cleaning device suitable for carrying and storing with a golf bag, said cleaning device comprising:

a collapsible container having an opening at an upper end to receive and contain the cleaning liquid therein;

a housing having an opening therethrough, said housing coupled to said upper end of said collapsible container, and said opening in said collapsible container communicating with said opening in said housing; and cleaning means coupled to said housing for engagement with the club head when received in said cleaning device.

2. The cleaning device of claim 1 wherein said cleaning device is collapsed to be stored in a minimum of space.

3. The cleaning device of claim 1 wherein said cleaning means comprises a plurality of brushes.

4. The portable cleaning device of claim 3 wherein said brushes extend inward from said housing over said opening in said collapsible container.

5. The portable cleaning device of claim 1 wherein said collapsible container is a flexible bladder.

6. The portable cleaning device of claim 1 wherein said collapsible container is removable and replaceable with another collapsible container.

7. The portable cleaning device of claim 6 wherein said collapsible containers are disposable.

8. The portable cleaning device of claim 1 wherein said collapsible container is collapsed when emptied of the cleaning liquid.

9. The portable cleaning device of claim 1 wherein said housing is a removable housing releasably attached to said collapsible container.

10. The portable cleaning device of claim 9 wherein said removable housing comprises interlocking inner and outer frames, said interlocking inner and outer frames configured to receive said collapsible container therebetween for securing said housing and said collapsible container together.

11. The cleaning device of claim 10 wherein said outer frame and said collapsible container each have a pair of laterally displaced openings, said pair of openings in said collapsible container corresponding with said pair of opening in said outer frame.

12. The cleaning device of claim 11 wherein said inner frame includes a pair of laterally displaced hooks, said hooks configured to be received and concurrently retained in said pairs of openings in said collapsible container and said outer frame.

13. The cleaning device of claim 10 wherein said outer frame includes a resilient retaining tab and said inner frame includes a tab receiving chamber, said retaining tab configured to be detachably received in said tab receiving chamber.

14. The cleaning device of claim 13 wherein said inner frame further includes a horizontally oriented hole, said horizontally oriented hole communicating with said tab receiving chamber, and said retaining tab being detached from said receiving chamber to permit said collapsible container to be removed from said housing when an object is received through said horizontally oriented hole in said inner frame and said object is urged against said retaining tab.

15. The cleaning device of claim 1 further comprising at least one vertically oriented hole in said housing for receiving and retaining golf tees.

16. The cleaning device of claim 1 wherein said collapsible container comprises a plurality of annular segments of graduated diameters which are extendible to form said collapsible container, said segment of the largest diameter coupled to said housing, and said segments being collapsible around said segment with the smallest diameter.

17. The cleaning device of claim 1 further comprising a plurality of flexible flap members coupled to said housing, said flap members collectively closing said opening in said housing when said flap members are in repose, and said flap members being displaceable to permit insertion of the golf club head into said collapsible container.

18. The cleaning device of claim 17 wherein said flap members are positioned beneath said cleaning means.

19. The cleaning device of claim 17 wherein said flap members are positioned above said cleaning means.

20. The cleaning device of claim 1 wherein said housing is deformable to permit said cleaning device to be stored in a minimum of space.

21. The cleaning device of claim 1 wherein said housing further comprises a door mounted thereto for preventing the spilling of cleaning liquid, said door permitting access to the cleaning liquid in said collapsible container when said door is opened.

22. A portable golf club cleaning device for cleaning the head of a golf club with a cleaning liquid, said cleaning device suitable for carrying and storing with a golf bag, said cleaning device comprising:

a collapsible bladder having an opening at an upper end to receive and contain the cleaning liquid therein;

a housing having an opening therethrough, said housing coupled to said upper end of said collapsible bladder, and said opening in said collapsible bladder communicating with said opening in said housing; and a plurality of brushes coupled to said housing for engagement with the club head when received in said cleaning device, said brushes extending inward from said housing over said opening in said collapsible bladder, wherein said cleaning device may be stored in a minimum of space when said collapsible bladder is collapsed.

* * * * *